US005493844A

United States Patent [19]

Combrink

[11] Patent Number: 5,493,844

[45] Date of Patent: Feb. 27, 1996

[54] PACKAGING CONTAINER FOR RECEIVING BULK MATERIAL, AND METHOD OF AND APPARATUS FOR MAKING A FLAT PACKAGING CONTAINER AS WELL AS VENTILATING AND SEALING THE FILLED PACKAGING CONTAINER

[75] Inventor: Alois Combrink, Oelde, Germany

[73] Assignee: Haver & Boecker, Oelde, Germany

[21] Appl. No.: 191,253

[22] Filed: Feb. 2, 1994

[30] Foreign Application Priority Data

Feb. 10, 1993 [DE] Germany ..... 43 03 894.8

[51] Int. Cl.[6] ..... B65B 9/00

[52] U.S. Cl. ..... 53/410; 53/434; 53/415; 53/450

[58] Field of Search ..... 53/415, 450, 433, 53/432, 434, 410

[56] References Cited

U.S. PATENT DOCUMENTS

| | | | |
|---|---|---|---|
| 3,504,475 | 4/1970 | Dickard et al. | 53/410 |
| 3,998,135 | 12/1976 | Sargent | 53/415 |
| 4,022,324 | 5/1977 | Schuster | 53/415 |
| 4,959,946 | 10/1990 | Doyle | 53/415 |
| 5,035,103 | 7/1991 | Akkala | 53/434 |

*Primary Examiner*—John Sipos
*Assistant Examiner*—Gene L. Kim
*Attorney, Agent, or Firm*—Henry M. Feiereisen

[57] ABSTRACT

A packaging container of the type being flat when empty for receiving bulk material includes a moisture-proof, thermoplastic layer connectable along a longitudinal seam which is defined by longitudinal edges and having a ventilation zone spaced in parallel relationship to the longitudinal edges and closable through heat sealing or welding after feeding bulk material into the interior and ventilating the bulk material. The ventilation zone of the packaging container is formed by initially leaving one of the longitudinal edges of the longitudinal seam open. Only after the packaging container is filled and the contents are allowed to ventilate is this initially open seam area closed by a welding or heat sealing process.

8 Claims, 6 Drawing Sheets

Fig. 4
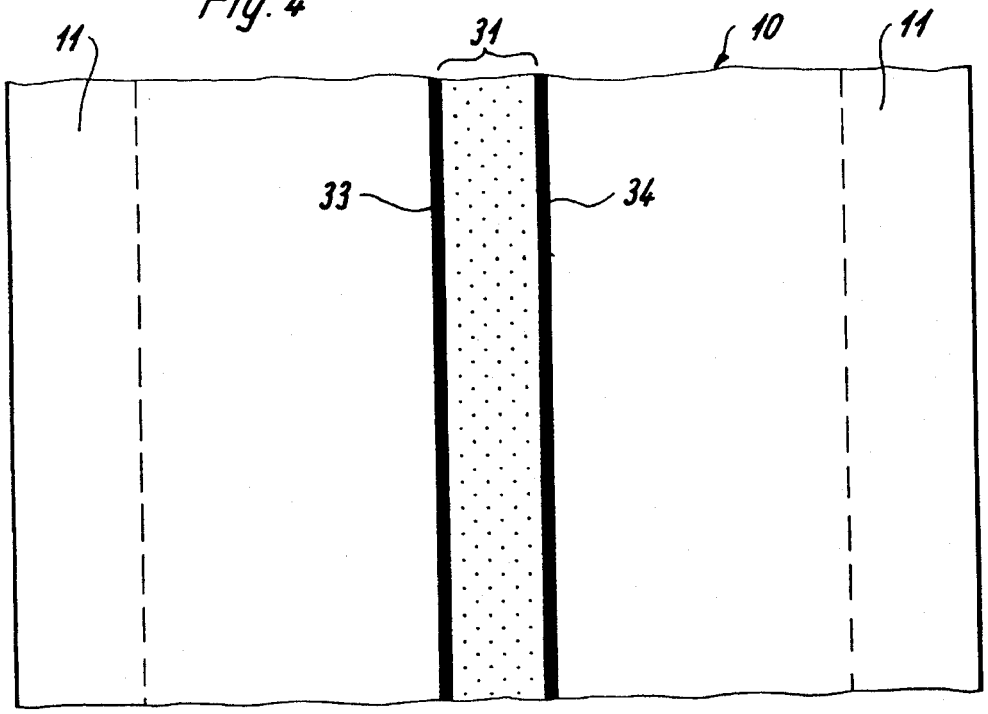
Fig. 5
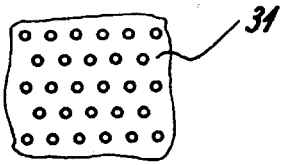
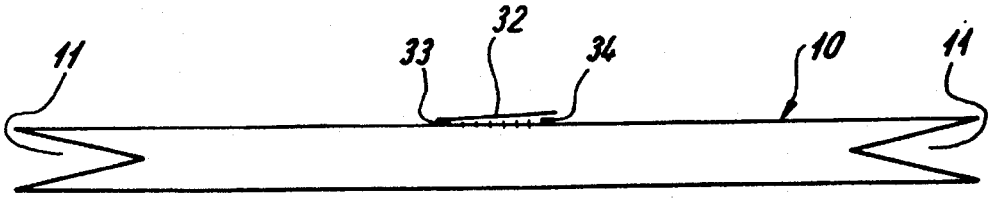
Fig. 6

PACKAGING CONTAINER FOR RECEIVING BULK MATERIAL, AND METHOD OF AND APPARATUS FOR MAKING A FLAT PACKAGING CONTAINER AS WELL AS VENTILATING AND SEALING THE FILLED PACKAGING CONTAINER

BACKGROUND OF THE INVENTION

The present invention refers to a packaging container which is flat when being empty for receiving bulk material and is of a type having an interior and a moisture-proof thermoplastic layer provided with a ventilation zone extending parallel at a distance to the longitudinal edges. Further, the present invention refers to a method of making an empty packaging container as well as a method and apparatus for ventilating and sealing the filled packaging container.

In order to raise the quality assurance of their contents, packaging containers, such as open sacks or sacks with bottom, should protect the contents from exposure to moisture penetrating through the sack layers. Conventional packaging containers come in various designs and are made of a plastic sheet, e.g. of a seamless tube or a sheet web which is subsequently formed to a tube. Further, paper sacks are known which usually include at least two paper layers, with a thermoplastic moisture-proof layer, e.g. a plastic liner being inserted between the paper layer for preventing a penetration of moisture. Paper sacks are exclusively made out of paper webs to form a continuous tube from which tube sections are cut to make the respective sacks.

Although a penetration of moisture is significantly decreased in paper sacks containing a thermoplastic moisture-proof layer or in sacks which are completely made of plastic material, there is the drawback that the sack interior cannot be ventilated. Air usually enters the sack interior during a filling process, especially in connection with powdery material when air is added to the material to render it transportable. Even though more recent filling methods allow a reduction of supply of air, a complete omission is not yet possible. Proposals to suitably design the filling machine in order to allow a withdrawal of air during the filling process remained unsatisfactory because e.g. in open sacks, residual air will still remain in the area of the filling unit.

In connection with filling coarse or grainy material, the ventilation during the filling process is satisfactory since a withdrawal of air is not inhibited by these contents. This is even true when closing the valve immediately after removal of the valve sacks from the feed socket of the filling machine. In sacks which are open at the top, residual air can be separated through pressure application above the contents before the closing step and then withdrawn through vacuum. While the ventilation is generally sufficient during filling of grainy or coarse material, the results during filling of powdery material remain unsatisfactory.

It is also known in connection with plastic sacks which contain granular material to puncture the side wall with a needle and then to evacuate the sack interior. Once ventilation is accomplished, the pierced location is covered by a sealing tape. This method is suitable only for granular material. Moreover, the sealing tape is made of a different material than the sack so that a subsequent disposal thereof causes problems because a reuse of the packaging material requires that the package is made of same or similar material.

It was further proposed to prevent a penetration of moisture into powdery contents by disposing an air tight thermoplastic intermediate layer between the paper layers. While this solution is suitable to protect the contents from penetration of moisture, it significantly complicates a ventilation of the contents. Therefore, proposals were made to leave the overlapping border strips of this air tight layer open. In this manner, a ventilation during filling and transport of the filled sack from the filling machine to the first peripheral device is possible since paper is air permeable and acts like a filter. Although a sufficient ventilation is ensured, this solution has the drawback that moisture can penetrate through the open longitudinal seam of the intermediate layer.

In connection with single-layer plastic sacks, it is also known to place a filter-like strip of non-woven fabric in the area of the longitudinal seam. This proposal also does not sufficiently inhibit a penetration of moisture through the non-woven strip into the sack content.

SUMMARY OF THE INVENTION

It is thus an object of the present invention to provide an improved packaging container obviating the afore-stated drawbacks.

In particular, it is an object of the present invention to provide an improved packaging container which permits a complete ventilation especially in connection with powdery material filled into the packaging container and yet prevents a penetration of moisture into the contents.

It is another object of the present invention to provide a method for making, ventilating and sealing a packaging container, which allows a ventilation through the longitudinal seam during transport of the filled packaging container and a hermetic and tight sealing of the filled packaging container.

It is still another object of the present invention to provide an apparatus for ventilating the packaging container, which is of simple structure and allows retrofitting of existing plants without significantly increasing expenses.

In accordance with the present invention, a packaging container includes a moisture-proof, thermoplastic layer which is formed into a tube along a longitudinal seam defined between the longitudinal edges and having a ventilation zone spaced in parallel relationship to the longitudinal edges and closable through heat sealing or welding after filling the packaging container with material such as bulk material and ventilating the content.

By allowing a heat sealing or welding process after filling the contents into the packaging container, an air exchange via the initially open ventilation zone of the moisture-proof layer is ensured during filling of the interior with powdery or grainy bulk material. This air exchange continues during the transport of the packaging container from the filling machine to the heat-sealing or welding station by means a conveyer. The ventilation zone is then sealed through heat application. Thereafter, the packaging container is completely protected by the thermoplastic layer from penetration of moisture.

A packaging container is made from a tube web and as such can be used in automatic packaging lines for forming, filling and closing packages, with the moisture-proof layer generally made from a thermoplastic sheet and receiving cross seams relative to the bottom seams and top seams during the production process for making unit packages.

The packaging container may also be provided in form of a sack or bag with or without lateral gussets and may be designed as a sack with open top for receiving the contents, with the top being closed after filling the contents e.g. through a folded bottom seam joint, or as valve sack or bag, with both ends of the sack or bag tubing being formed as cross bottom or pad bottom.

Frequently, packaging containers include multiple layers, with the number of layers based upon the layers of a sack wall. The same is true for bags. These packaging containers are made from one or more flat webs through formation of a tube. In accordance with another feature of the present invention, the longitudinal seam of such packaging containers for formation of the ventilation zone is initially open and closable after ventilation of the bulk material through a heat-sealing or welding process. In this manner, it is only necessary to leave the longitudinal seam of the thermoplastic moisture-proof layer open during formation of the tube. Suitably, a strip of thermally activatable adhesive is applied onto the initially open longitudinal seam at the side of the flat material which includes the moisture-proof thermoplastic layer for allowing a closing of the longitudinal seam after the packaging container is filled with bulk material. Preferably, the adhesive strip is a hot melt adhesive with a softening temperature lower than the softening temperature of the moisture-proof thermoplastic layer.

A basic feature of the present invention is the provision of a moisture-proof thermoplastic layer with a ventilation zone. This teaching is also applicable for packaging containers which are made from a seamless thermoplastic tube. In this case, the ventilation zone is formed through a microperforation in one wall surface, with a masking tape covering the area of the microperforation. The masking tape is secured along one longitudinal edge to the wall surface while the opposite longitudinal edge remains initially detached to allow ventilation of the bulk material. After ventilation, the initially open longitudinal edge of the masking tape is secured through heat sealing or welding for sealing the ventilation zone. This masking tape is supplied during production of the packaging container and may be made of a same material as the layer to which it is attached. In order to ensure a tight closing of the ventilation zone, it is certainly feasible to secure not only the initially open longitudinal edge to the sack wall surface but also the ends extending transversely thereto.

In accordance with the present invention, a method for making, ventilating and closing a packaging container according to the invention is attained by closing the ventilation zone of the moisture-proof thermoplastic layer through a heat-sealing or welding process immediately before the transfer of the filled packaging container from the filling machine to the subsequent peripheral unit. Since the heat-sealing or welding process takes place immediately before the first peripheral unit, the entire transport path can essentially be utilized for ventilation of the contents. Existing plants can easily retrofitted e.g. by installing the heat-sealing or welding station immediately before the first peripheral unit in order to allow a closing of the packaging container.

In the event, the packaging container is made by forming a tube from one or several flat webs, it is preferred to provide the longitudinal seam over a defined area with a plasticizable bonding material which has a melting point below the melting point of the thermoplastic layer.

The present invention is based upon the teaching that the longitudinal seam of the thermoplastic, moisture-proof layer remains initially open and is closed only after a sufficient ventilation time. These sacks are then sealed hermetically. Since the bonding material is provided within the longitudinal seam, there is no necessity to apply disturbing external masking tapes.

An apparatus for carrying out a method according to the present invention necessitates only modest modifications since only a heat source and depending on the design a pressing unit is required. The plasticizable bonding material is advantageously a coating with a melting point lower than the melting point of the material from which the air impermeable sack layer or barrier layer is made. Suitably, the coating may be applied only onto one of both border strips. Instead of such a coating, also an adhesive tape may be applied onto one of both border strips and later reactivated through heat application. Such adhesives are conventionally known as hot melt adhesives.

It is also possible to apply a strip of air permeable material onto the air impermeable layer within the longitudinal seam. A typical material is e.g. nonwoven fabric. The coating or the adhesive or the bonding tape is applied during formation of the tubing such that the formation of a bottom or the application of a sealing seam is not interfered with.

In paper sacks, the air-impermeable and thermoplastic barrier is arranged in such a manner that the outermost layer is still a paper layer, thus enabling the plastification through only one paper layer. Taking as an example a three-layered sack, the outer and the inner layer would thus be a paper layer while the middle layer would constitute the air tight barrier. In multi-layered sacks, the plasticizable bonding material is preferably the coating or the adhesive tapes while the air permeable bonding strip is utilized in particular for single layer plastic sacks.

The method according to the invention is suitable for open sacks as well as for valve sacks. Moreover, the method is applicable for all types of sacks as long as they are made from a web.

Suitably, the initially open area of the longitudinal seam of the filled packaging container is closed just before transfer to the peripheral unit in order to allow utilization of almost the entire path for ventilation.

An apparatus for carrying out the method according to the invention includes a heating unit for plasticizing the bonding material which is arranged in transport direction in the rearward area of a conveyer by which the filled packaging container is transported from the feed unit. Since the filled packaging container is transported in a flat position with the longitudinal seam facing upwards, the heating unit is spaced from the conveyer to thereby define a passageway for the packaging container. Since it is advantageous to pressurize the border strips forming the longitudinal seam after plastification of the bonding material, the heating unit is preferably a stationary shoe which simultaneously serves as press-on element.

BRIEF DESCRIPTION OF THE DRAWING

The above and other objects, features and advantages of the present invention will now be described in more detail with reference to the accompanying drawing in which:

FIG. 4 shows a schematic view of a single-layer packaging container made from a plastic tube with lateral gussets and provided with a microperforation defining a ventilation zone;

FIG. 5 is an enlarged view of a section of the ventilation zone of FIG. 4;

FIG. 6 is a sectional view of the packaging container according to FIG. 4;

DETAILED DESCRIPTION OF PREFERRED EMBODIMENTS

Figure 1:
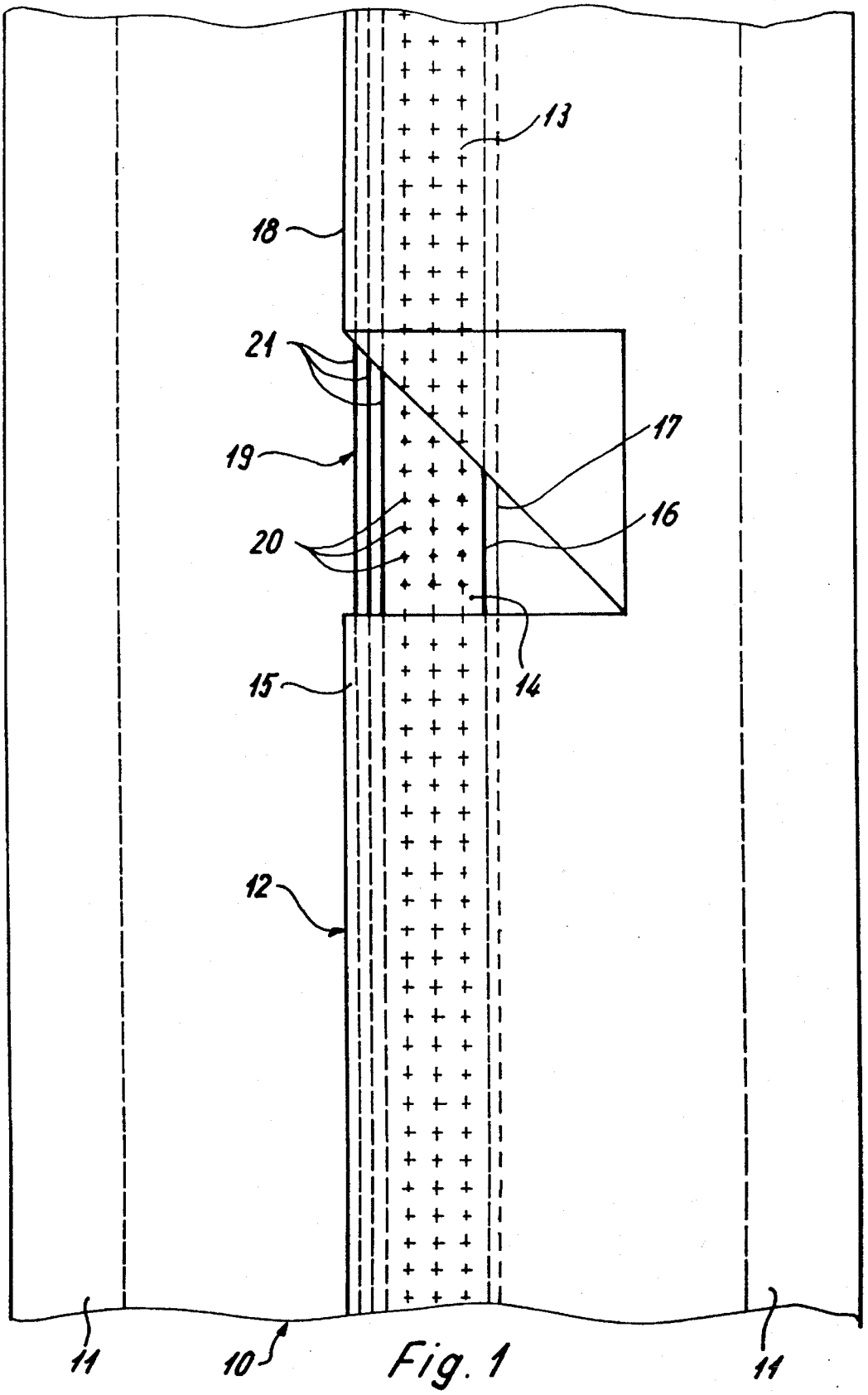
FIG. 1 is a schematic view of a packaging container according to the present invention in form of a section of a tube web, illustrating in detail the area of the tube-forming longitudinal seam, with a portion of the upper layer of the longitudinal seam being cut open and folded backwards.

Throughout all the figures, the same or corresponding elements are usually indicated by the same reference numerals.

Referring now to the drawing, and in particular to FIG. 1, there is shown a section of a tube web for forming a packaging container, generally designated by reference numeral 10. The tube web 10 is made from a flat sheet of thermoplastic material, e.g. polyethylene, which is suitably shaped to provide a tube-forming longitudinal seam, generally designated by reference numeral 12, and to form lateral gussets 11. The longitudinal seam 12 is part of an overlap zone 13 which is formed by folding the thermoplastic sheet in such a manner that the longitudinal border strips overlap each other to provide an inner layer 14 and an outer layer 15. The tube web 10 of thermoplastic material is moisture-proof and forms a barrier for the contents in the packaging containers. These packaging containers are single units which are made from the tube web 10 and filled with material by an apparatus for forming, filling and closing of the containers.

In order for air to escape from the interior of the packaging container during and after a filling process, the longitudinal seam 12 includes initially, i.e. as dummy or empty container, only one continuously closed strip-shaped longitudinal seam 16 which adjoins the inner edge 17 of the lower layer 14 while the opposite longitudinal seam 19 which in the overlap zone 13 adjoins the outer edge 18 of the upper layer 15 is initially, i.e. when the tube web 10 is empty, left continuously open to serve as a ventilation zone.

The lower material layer 14 is provided between the spaced longitudinal seams 16, 19 in the overlap zone 13 with a perforation 20, a so-called microperforation, in form of fine needle holes. This microperforation 20 which is schematically illustrated in FIG. 1 by cross points retains the contents within the interior of the packaging container, but still permits air introduced during the filling process to escape through the initially open longitudinal seam 19 into the atmosphere.

Although not illustrated in detail, it is certainly conceivable to place between the perforated lower layer 14 and the upper layer 15 in the overlap zone 13 a narrow sheet of filter material, e.g. non-woven fabric, which has a width covering the area between the longitudinal seams 16, 19. In this manner, the perforations 20 may be dimensioned of greater hole diameter to ensure escape of air via the still open longitudinal seam 19 while contents are still retained within the interior during a filling process and following pressure application for closing the filled packaging container.

The initially open longitudinal seam 19 is prepared by applying a strip-shaped coating of a thermally activatable adhesive (hot melt) in the overlap zone 13 onto the lower layer 14 of the flat plastic sheet. After the packaging container is filled with material, the adhesive is activated through heat application for sealing the longitudinal seam 19. The adhesive coating includes several parallel single strips 21 which rapidly cool down after application and can easily be activated to ensure a tight sealing. Advantageously, the adhesive is selected in such a manner as not to show any block or sticking tendency and yet to have a low melting point which especially is lower than the melting point of the thermoplastic barrier upon which the adhesive strips 21 are applied. This ensures that the layer of the tube web 10 upon which the adhesive strips 21 are applied will not be adversely affected during the subsequent heat-sealing process for closing the longitudinal seam 19 through bonding of the material layers 14, 15 in the overlap zone 13 so that the filled packaging container is hermetically sealed after the cooling process. This is especially true for packaging containers which as empty containers are open on one side.

Figure 2:
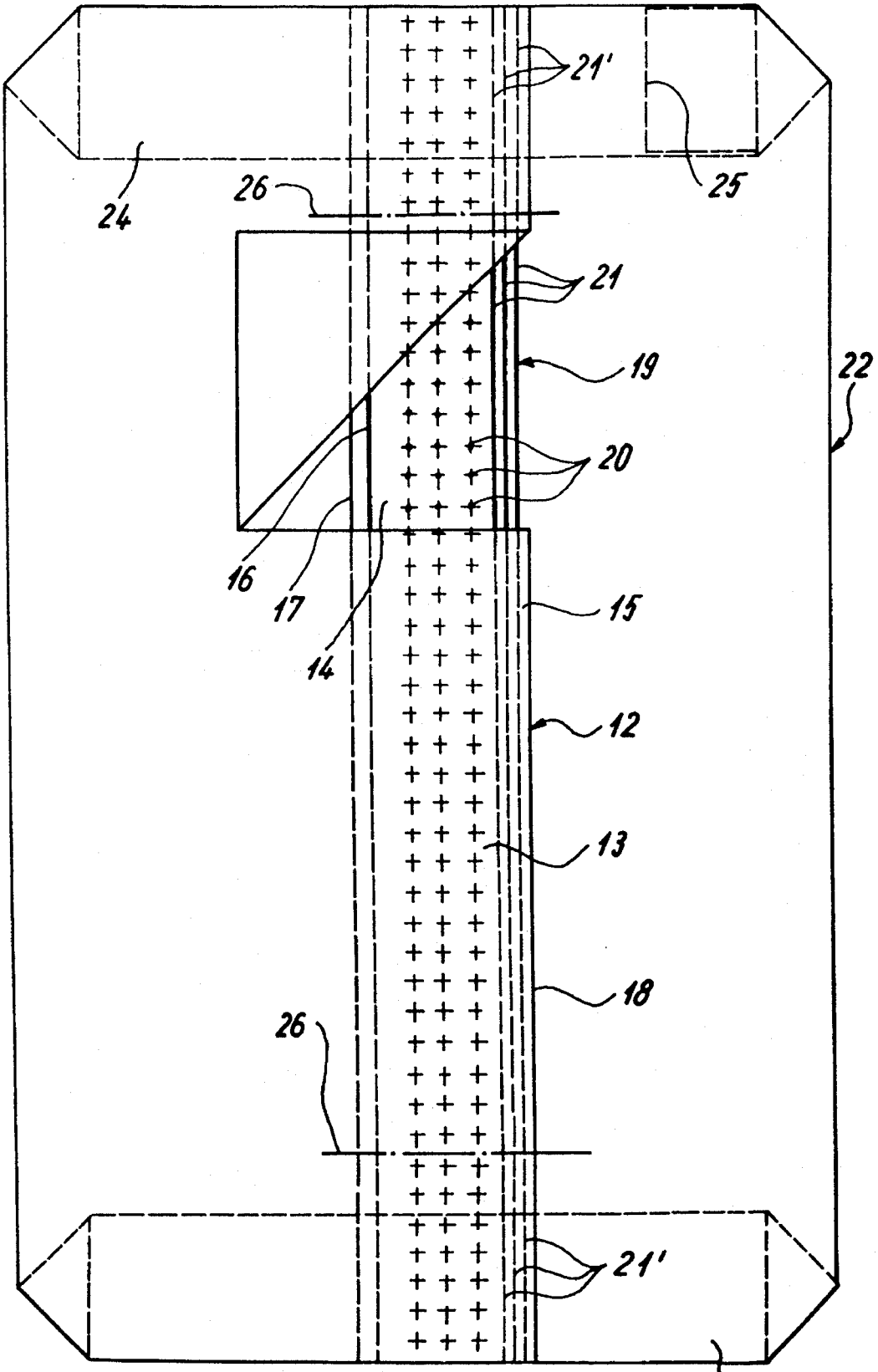
FIG. 2 is a schematic view of a packaging container in form of a cross bottom valve sack, illustrating in detail the area of the tube-forming longitudinal seam, with a portion of the upper layer of the longitudinal seam being cut open and folded backwards.

Turning now to FIG. 2, there is shown a simplified schematic illustration of a packaging container in form of a cross bottom valve sack 22 which is provided at both its ends with a cross bottom 23, 24, with the cross bottom 24 being designed as valve bottom through incorporation of a feed valve 25.

In a same manner as the embodiment of the packaging container according to FIG. 1, the cross bottom valve sack 22 is made of a single layer of thermoplastic sheet and includes the tube-forming longitudinal seam 12 which at empty container is closed only by the longitudinal seam 16 while the adhesive strips 21 of the longitudinal seam 19 are initially open, with the exception of the immediately adjacent sections 21' which include the cross bottoms 23, 24. At empty packaging containers, these sections 21' are sealed preferably in a same manner as the longitudinal seam 16 which is formed through bonding both material layers 14, 15 in the overlap zone 13 immediately after applying e.g. a hot melt adhesive through extrusion. The boundary between the adhesive sections 21', which are already initially bonded or heat-sealed with the material layers 14, 15, and the central, initially open seam area 19 between the sections 21' is indicated in FIG. 2 by dash dot lines 26. A complete closing of the longitudinal seam 12 in the bottom areas (sections 21') facilitates the later heat-sealing process through activation of the adhesive strips 21 between the lines 26 as the heat-sealing process is limited to an essentially flat border area of the sack 22.

Persons skilled in the art will understand that the sack 22 may certainly be provided with a paper layer which lines the inside of the sack 22 to serve as filter by which during filling and subsequent pressure application for closing the filled sack an escape of contents through the perforations 20 is prevented while air is allowed to exit through the filter material and perforation 20 via the not yet activated adhesive strips 21. In this manner, the adhesive strips 21 are kept free from contaminations through contents, thus considerably facilitating the subsequent complete heat-sealing process.

Figure 3:
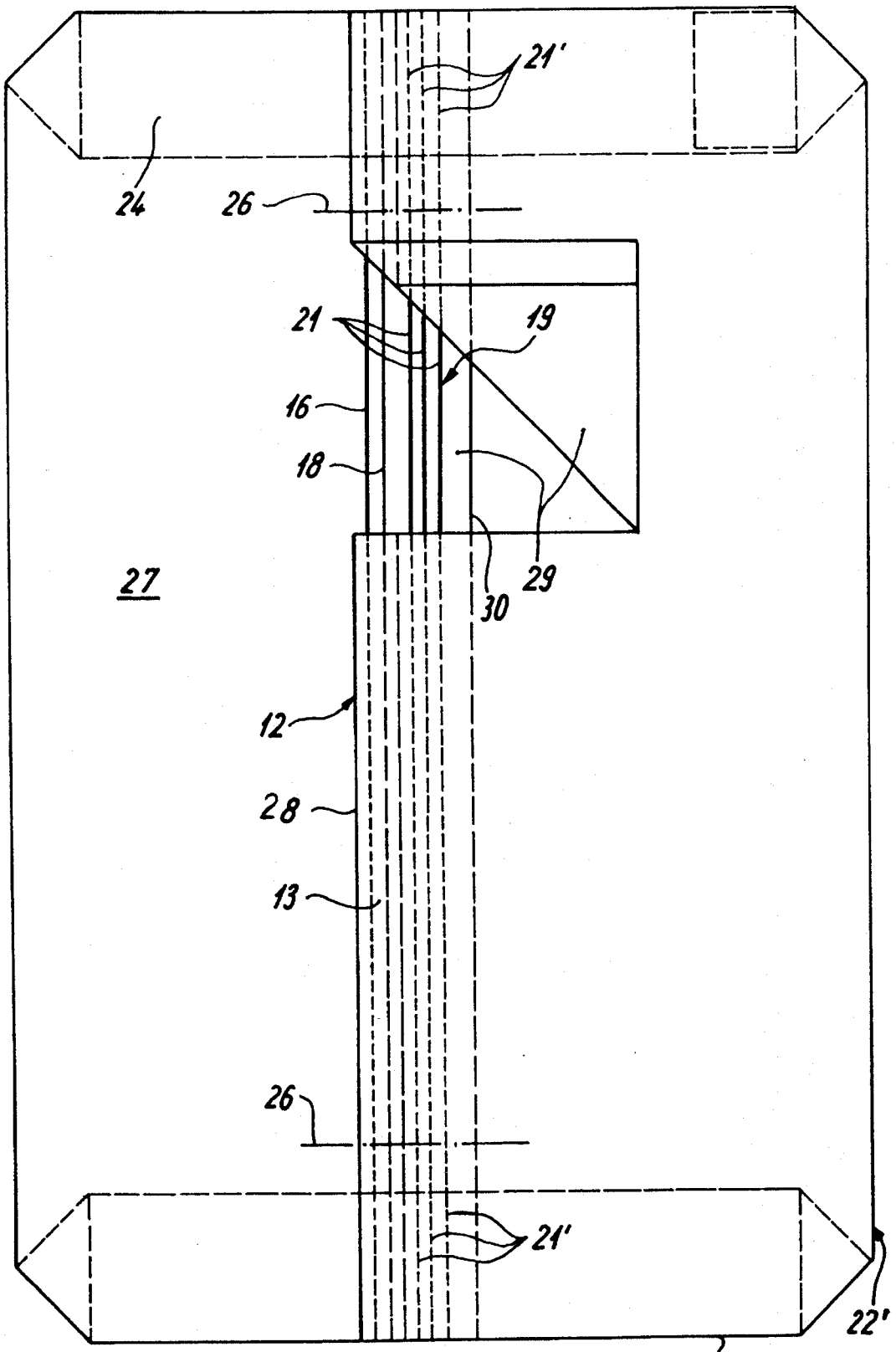
FIG. 3 is a schematic illustration of a variation of a packaging container in form of a cross bottom valve sack, similar to FIG. 2.

Turning now to FIG. 3, there is shown a modification of a packaging container in form of a cross bottom valve sack, generally designated by reference numeral 22' which differs from the valve sack 22 essentially by providing the flat thermoplastic material which forms the sack 22' in the area of the longitudinal seam 12 with two laterally staggered layers in form of an outer paper layer 27 with an inner edge 28 in the overlap zone 13 and a moisture-proof barrier layer 29 with an inner edge 30 in the overlap zone 13. The barrier 29 may be made from a single thermoplastic sheet, e.g. a polyethylene sheet or a three-layer composite sheeting which is laminated or co-extruded with a barrier material between two outer plastic layers. As in previous embodiments, the longitudinal seam 16 is the part of the longitudinal seam 12 which connects the layers 14 and 15 in the overlap zone 13 and is closed during making of the sack 22' while the longitudinal seam 19 in the area between boundary lines 26 remains initially open and is activated through heat-sealing only after filling and sufficient ventilation.

During filling of the sack 22' and subsequent transport of the filled sack 22', air can exit through the loosely superposed areas of the barrier 29 via the still inactive adhesive strips 21 and the upper (outermost) paper layer 27 in the overlap zone 13 at the outer border area defined by the longitudinal seam 16. Persons skilled in the art will understand that also in this embodiment, the inside of the barrier 29 may be covered by a paper layer which lines the filling space of the sack 22' for retaining the contents and allowing exit of air in a manner described above.

A packaging container according to the present invention with a barrier which is initially open along a defined area of the longitudinal seam 12 is made by a suitably designed sack manufacturing machine. Tube sections serve as base material and are cut from an endless tube. These tube sections are made by a suitable tube drawing machine which is designed in such a manner that defined areas of the longitudinal seam 12 of the barrier are left open. If desired, also non-wovens may be supplied. The empty sacks are then filled by conventional filling machines.

It will be understood by persons skilled in the art that tube drawing machines, sack manufacturing machines and filling machines are generally known and do not form part of the present invention so that a detailed description thereof is omitted for sake of simplicity.

Turning now to FIGS. 4 to 6, there is shown a section of a seamless tube web 10 with gussets 11 for making sacks or bags in form of single-layer packaging containers. The single layer thus also forms the thermoplastic and moisture-proof layer. As shown in FIG. 6, the upper wall surface of the tube web 10 is provided with a ventilation zone 31 in form of a so-called microperforation for allowing escape of air after the packaging container is filled with material. FIG. 5 more clearly shows the microperforation in form of fine punctures which are dimensioned to permit an escape of air to the outside while retaining particles of the bulk material from passing therethrough.

In order to hermetically seal the packaging container after being filled, the ventilation zone 31 is closed by a masking tape 32 which as shown in FIG. 4 is initially secured to the upper wall surface of the tube web 10 only along one border edge (left edge in FIGS. 4 and 6) via a weld 33 or a suitable bonding seam. The masking tape 32 can be supplied during making of the packaging container from the tube web 10 and may extend over the entire length of a tube section which is cut from the tube web 10. If desired, the length of the masking tape 32 may also be shorter.

After ventilation of the packaging container, the opposing border edge (right edge in FIGS. 4 and 6) of the masking tape 32 is secured to the upper wall surface of the packaging container via a weld or bonding seam 34. In case of applying a bonding seam, a strip of thermally activatable adhesive is applied onto the surface in a same manner as the adhesive strips 21. The melting point of the adhesive should also be below the melting point of the thermoplastic sheet from which the tube web 10 is made.

Persons skilled in the art will understand that the ventilation zone 31 of a packaging container may further be sealed by seams extending transversely to the weld or bonding seams 33, 34.

Figure 7:
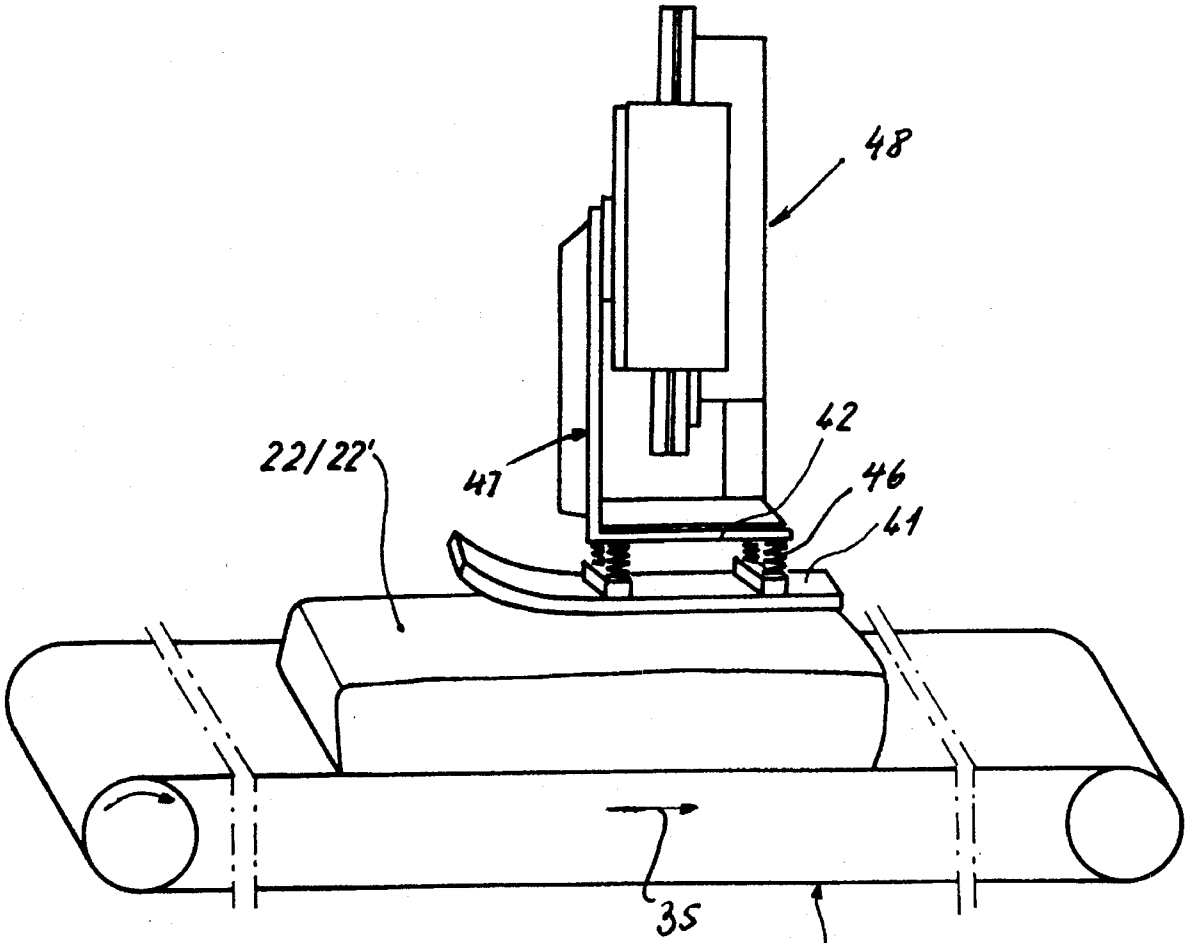
FIG. 7 is a schematic, simplified perspective view of a sealing apparatus according to the present invention for closing the initially open ventilation zone of a filled sack.

Turning now to FIG. 7, there is shown a schematic, simplified perspective view of a sealing apparatus according to the present invention for closing the initially open ventilation zone of a filled sack. In case the seam 34 is made of a thermally activatable adhesive, the packaging container according to FIGS. 4–6 can also be hermetically sealed after ventilation through the sealing apparatus as shown in FIG. 7.

After the packaging container is filled with bulk material by a suitable filling machine, a conveyer 40, such as a simple conveyer belt, transports the filled sacks 22, 22' in direction as indicated by arrow 35. The sacks 22, 22' are placed flat on the conveyer 40, with their longitudinal seam 12 facing upwards toward the sealing apparatus by which the still open longitudinal seam 12 is closed. The sealing apparatus is suitably positioned at the end of the conveyer 40 which then transports the sacks 22, 22' in direction of arrow 35 to a (not shown) peripheral unit, e.g. for palletizing. The length of the conveyer 40 should be dimensioned to allow sufficient time for ventilating of the contents.

The sealing apparatus includes a heat source in form of a shoe-type heater 41 which is spaced at such a distance to the upper (carrying) run of the conveyer 40 as to allow a contacting of the advancing sacks 22, 22' along the upper surface with its longitudinal seam 12. The heat shoe 41 is resiliently connected by springs 46 to a support plate 42 so that the heat shoe 41 is pressed at a certain force against the longitudinal seam 12 of the sack 22, 22'. The support plate 42 is the horizontal shank of an angle-shaped element, generally designated by reference numeral 47. Suitably, the heat shoe 41 is outwardly arched at the incoming side to facilitate entry and passage of the advancing sacks 20, 22. The heat shoe 41 is part of an electric resistance heating unit which is generally designated by reference numeral 48. The resistance heating unit 48 does not form part of the present invention so that a detailed description thereof is omitted for sake of simplicity.

Preferably, the sealing apparatus is designed to allow a height adjustment of the heat shoe 41 relative to the packaging container. In this manner, the sealing apparatus is usable for a wide range of different sack widths. The heat shoe 41 is best suited for a heat-sealing process. If the open areas of the longitudinal seam 12 of the barrier should be closed through a welding process, a suitable welding unit must be employed.

Figure 8:
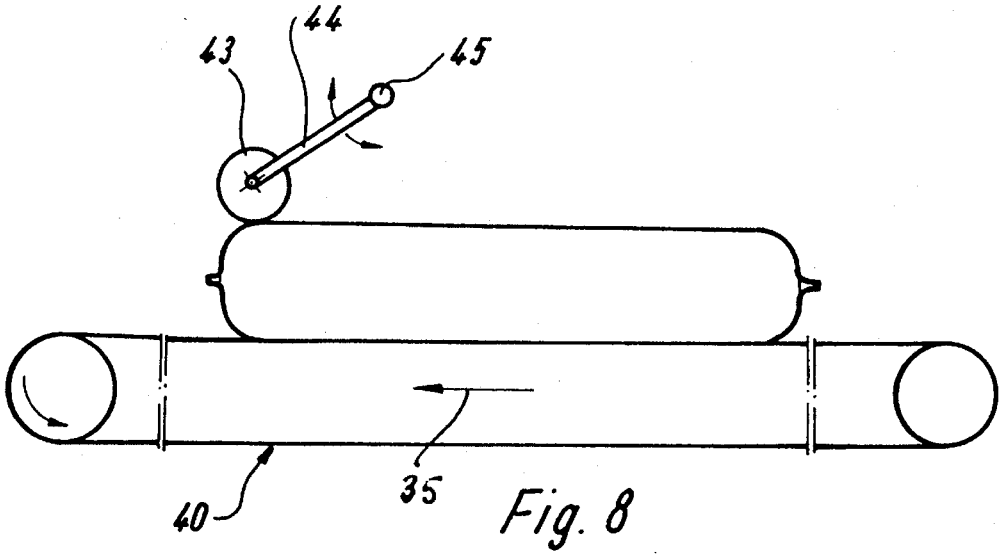
FIG. 8 is a schematic, simplified view of another embodiment of a cleaning apparatus for closing the initially open ventilation zone of the filled sack.

Turning now to FIG. 8, there is shown a second embodiment of a sealing apparatus for closing the ventilation zone 31 by sealing the longitudinal seam 16. Depending on the type of packaging container, the ventilation zone 31 may extend also beyond the front and rear bottom area or end face area. In order to seal also this area after the ventilation, the heating unit includes a heating drum 43 rotatably supported by a swivel arm 44 which pivots about a horizontal axis 45. The leading bottom or the leading end face of the filled packaging container strikes first the heating drum 43 which upon further transport of the packaging container by the conveyer 40 in direction of arrow 35 swings in such a manner that the heating drum 43 rolls on the ventilating zone 31 along the upper surface of the packaging container. The heating drum 43 is lowered as soon as the packaging container is sufficiently transported and the ventilation zone of the upper surface is closed.

Figure 9:
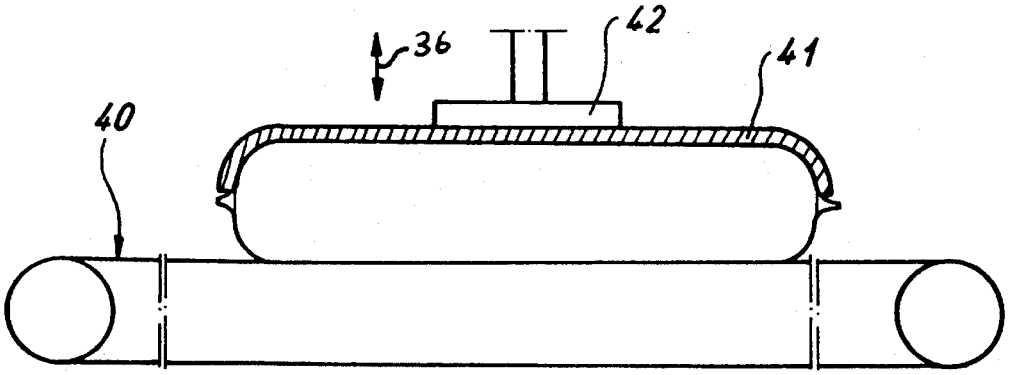
FIG. 9 is a schematic simplified illustration of yet another embodiment of a cleaning apparatus for closing the initially open ventilation zone of a filled sack.

FIG. 9 is a schematic simplified illustration of another embodiment of a sealing apparatus for closing the ventilation zone 31 by sealing the longitudinal seam 16. In contrast to the previous embodiments in which the packaging container is continuously advanced, i.e. the conveyer 40 runs continuously, the sealing apparatus of FIG. 9 operates with an intermittently operated conveyer 40 such that the actual sealing process occurs while the conveyer 40 is at a standstill. This sealing apparatus also allows a closing of the bottoms and end walls of the packaging container and includes a shoe-type heater 41 which is dimensioned to match the longitudinal configuration of the packaging container and arched at both ends so that the bottoms or end walls of the packaging container are contacted to about the center. The heat shoe 41 is also mounted to a support plate 42. Although not shown in detail, the heat shoe 41 is operated intermittently in synchronism with the conveyer 40 in vertical direction, as indicated by double-arrow 36. Persons skilled in the art will understand that all elements for moving the conveyer 40 and the heat shoe 41 as well as the heating unit for the heat shoe 41 do not form part of the present invention and thus have been omitted from the drawings.

While the invention has been illustrated and described as embodied in a packaging device for receiving bulk material, and method of and apparatus for making a flat packaging container as well as ventilating and sealing a filled packaging container, it is not intended to be limited to the details shown since various modifications and structural changes may be made without departing in any way from the spirit of the present invention.

What is claimed as new and desired to be protected by Letters Patent is set forth in the appended claims:

I claim:

1. A method of packaging powdery material, comprising the steps of:

shaping a moisture-proof, thermoplastic layer such that opposite ends overlap each other to form an inner layer and an outer layer in an overlap zone;

sealing the inner layer and the outer layer along a longitudinal seam at a spaced location from the end of the outer layer to form a packaging container; that has one closed end and a material receiving end forming a ventilation zone between said longitudinal seam and the end of the outer layer in the overlap zone;

filling the packaging with powdery material through said material receiving end while said air escapes through said ventilation zone; and closing said material receiving end and sealing the ventilation zone of the thermoplastic layer along a further longitudinal seam through heat sealing or welding immediately before transferring the packaging container to a subsequent peripheral unit.

2. A method as defined in claim 1 wherein said shaping step includes forming a tube from a flat web at formation of the longitudinal seam and providing the longitudinal seam over a defined area with a plasticizable bonding material having a melting point below the melting point of the thermoplastic layer.

3. A method as defined in claim 2 wherein said providing step includes applying the plasticizable bonding material upon an initially open border area of the longitudinal seam for sealing thereof.

4. A method as defined in claim 2 wherein said providing step includes applying the plasticizable bonding material in form of pressure sensitive tape upon an initially open border area of the longitudinal seam for sealing thereof.

5. A method as defined in claim 2 wherein said providing step includes applying the plasticizable bonding material in form of an air permeable bonding tape onto the thermoplastic layer.

6. A method as defined in claim 5 wherein said applying step includes using a non-woven as air permeable bonding tape.

7. A method as defined in claim 2 wherein said sealing step includes plasticizing the bonding material by a heating unit.

8. A method as defined in claim 7 wherein said sealing step includes plasticizing the bonding material by an electric resistance heater.

* * * * *